US005992565A

United States Patent [19]

Lingen

[11] Patent Number: 5,992,565

[45] Date of Patent: Nov. 30, 1999

[54] LIFTING SCAFFOLD ASSEMBLY

[76] Inventor: Paul Lingen, Grefratherstr 42, 47669 Wachtendonk / Wankum, Germany

[21] Appl. No.: 08/927,480

[22] Filed: Sep. 11, 1997

Related U.S. Application Data

[63] Continuation of application No. 08/397,944, Mar. 3, 1995, abandoned.

[30] Foreign Application Priority Data

Mar. 3, 1994 [DE] Germany ..... 44 06 987

[51] Int. Cl.[6] ..... E04G 1/20

[52] U.S. Cl. ..... 182/141; 182/145

[58] Field of Search ..... 182/82, 96, 141, 182/145, 148

[56] References Cited

U.S. PATENT DOCUMENTS

| | | | |
|---|---|---|---|
| 2,390,284 | 12/1945 | Woody et al. | 182/145 |
| 3,548,970 | 12/1970 | Hutchens Sr. | 182/141 X |
| 3,878,916 | 4/1975 | White, Jr. | 182/148 X |
| 3,937,301 | 2/1976 | Bentail | 182/141 X |
| 4,293,054 | 10/1981 | Pieri | 182/148 X |
| 4,294,332 | 10/1981 | Ready | 182/141 |
| 4,655,319 | 4/1987 | Loix | 182/96 |
| 5,067,587 | 11/1991 | Mims, Jr. et al. | 182/145 |
| 5,159,993 | 11/1992 | St-Germain | 182/82 |

FOREIGN PATENT DOCUMENTS

| | | |
|---|---|---|
| 0418173 | 3/1991 | European Pat. Off. . |
| 2667582 | 4/1992 | France . |
| 2163507 | 7/1973 | Germany . |
| 2347974 | 4/1974 | Germany . |
| 3114602 | 4/1984 | Germany . |
| 3420737 | 3/1985 | Germany . |
| 3415074 | 10/1985 | Germany . |
| 3526105 | 2/1986 | Germany . |

*Primary Examiner*—Peter R. Brown
*Assistant Examiner*—James O. Hansen
*Attorney, Agent, or Firm*—Watson Cole Grindle Watson, P.L.L.C.

[57] ABSTRACT

A lifting scalfold assembly with several scaffolding poles which stand on a base and which are extendable in length and, between which mobile platforms are situated such that they can be adjusted in height, whereby the scaffolding poles are attached to a building by means of holding supports each scaffolding pole includes at least a girder section housing which at least a gear rack on an inside and a gear rack on an outside thereof. On the mobile platforms cogwheels and drives for the cogwheels running on the outer gear racks are provided. A sliding module or carriage includes cogwheels and drives for the cogwheels running on the inner gear connected to the girder section. Conduction rails are included on the scaffolding pole, and current collectors are positioned on the connectable mobile platforms and the sliding modules.

24 Claims, 9 Drawing Sheets

LIFTING SCAFFOLD ASSEMBLY

CROSS-REFERENCE TO RELATED APPLICATION

This application is a continuation of application Ser. No. 08/397,944, filed Mar. 3, 1995, now abandoned.

BACKGROUND OF THE INVENTION

1. Field of the Invention

The invention relates to a lifting scaffold having multiple frame poles which stand on a base and can be extended by lengths, between which mobile platforms are arranged so that they can be adjusted in height by means of multiple holding supports attached on the building face.

2. The Prior Art

A scaffold for repair work on facades and eaves is known from DE-OS 35 26 105, which discloses a climbable scaffold bridge between two mobile lifting scaffolds, whereby the scaffold bridge can be shifted in work height on the running guides or traverses in the direction of the facade.

In DE-OS 31 14 602 an arrangement for a work scaffold is described with liftable and lowerable working platforms with associated safety devices. The working platform is arranged between four guide rails provided with grooves and connected on both sides over a lifting mechanism and a suspension with the guide rails. On both sides of the working platform a support bar is arranged with the help of which the working platform rests on the scaffolding poles. Drop latches are arranged on the support bar which prevent a sharp drop in the working platform, since they latch into grooves of the guide rails during a wrenching of the chain of the lifting mechanism.

A lifting working platform, especially a working platform for building tradesmen, is known from DE-OS 34 15 074. The lifting working platform has a working platform connected to a stand such that it can be adjusted in height, the working platform having at least two crossbeams arranged at a distance from one another which can be connected to each other by vertical beams, which are provided with guide rails over which the crossbeams each run or in a pole such that they can be adjusted in height.

The object of the present invention is to provide a lifting scaffold of the noted type wherein the scaffold builds itself up and down through arrangements suitable to the scaffold, so that comparatively few workers are required for the building of a relatively large scaffold.

SUMMARY OF THE INVENTION

This object is achieved by the invention in that a scaffolding pole has at least a girder section on which at least each of a gear rack on the outside and a gear rack on the inside are provided, that on the mobile platform cogwheels and drives for the cogwheels running on outer gear racks and on a sliding module connectable to the girder section with cogwheels and drives for the cogwheels running on the inner gear racks are provided, and that on the scaffolding poles conductor rails and on the connectable mobile platforms and on the sliding module current collectors are provided.

In this way a lifting scaffold assembly is obtained which can be constructed by a few people especially with the help of the carriage, by which the carriage transports the individual scaffold sections upward by lengths, especially the scaffolding poles along the poles already attached to the facade. In particular, no assistance not related to the scaffold, as a crane or other similar device, is necessary for the construction and disassembly of the scaffold.

Instead of a girder section, there is also the possibly that the scaffolding pole has two girder sections which are attached to each other by struts or similar means.

It is desirable that the carriage be equipped in such a way that it can take over additional functions as for example crane replacement, an elevator for workers or materials, and similar functions.

A scaffolding pole transport module is suitable as one of the sliding modules. In this way it is possible to transport additional scaffolding pole modules upwardly with the sliding module along the already partially erected scaffolding poles for the further construction of the scaffolding or, alternatively, to transport the length of pipe from the top to the bottom when disassembling the lifting scaffold assembly.

The sliding modules can also be suitably constructed as a personnel and/or material elevator. In this way, people can ride, board and leave the scaffold and in addition it is possible to transport the materials and tools necessary for the work to be completed.

The personnel and/or materials elevator can be suitably swivelled to both sides around the scaffolding pole to the facade.

Occasionally it is suitable that one of the sliding modules is a crane. Through this the possibility exists to unload materials from the lifting scaffold itself from a truck or the like, without requiring an additional crane or automatic crane.

In a further configuration of the invention the lifting scaffold can be constructed in a such a way that the mobile platforms are equipped with a positioning device which can be moved over the entire width of the mobile platform on a mobile mounting. With a positioning device of this kind the possibility exists to accomplish the motions:

a) lifting and lowering;

b) lateral shifting to the left and right;

c) shifting longitudinally forwards and backwards;

d) tilting about a horizontal longitudinal axis above to the left and the right;

e) turning about a vertical axis to the left and to the right; and f) swivelling about a horizontal cross axis. This makes the acceptance, movement, holding and release of construction pieces possible.

Advantageously the mobile platform can be freely fixed in its length between the scaffolding poles.

It is preferred that the mobile platforms be movable on rails horizontal and parallel to the facade wall in opposite directions.

In addition, it is appropriate when the mobile platform railing pointing toward the facade is used for the extension of the platform floor to the facade.

An electric or electro-hydraulic drive is preferably provided on the carriage for the cogwheel running or the inner gear rack.

In a further embodiment of the invention the lifting scaffold can be constructed in such a way that the mobile platforms have electric or electro-hydraulic drives to drive the cogwheels. Advantageously each drive is provided with two cogwheels lying on top of one another. The possibility also exists that each drive may be provided with two cogwheels lying across from one another. Two opposing gear racks are provided suitably on each of the girder sections of the scaffolding poles, in each of which a cogwheel runs. It is however also possible that at least one cogwheel is provided for security against the carriage and the mobile platform plunging and equipped with a device for this purpose. For avoiding accidents it is recommended that each of the cogwheels lying on top of each other is provided for security against the slide block and the mobile platform falling.

After erecting at least two parallel scaffolding poles, the first mobile platform can be inserted between the scaffolding poles and driven to the upper end of the already erected scaffolding poles to place the next section of scaffolding pole.

A construction worker riding along on the mobile platform is in a position to attach the next section of scaffolding pole that comes up to the already standing scaffolding pole and to the facade. After at least two sections of scaffolding pole have been raised, the construction worker can ride with the mobile platform to the end point of the scaffolding poles already raised and wait there for the arrival of the next section of scaffolding pole for further assembly. With an additional construction worker to accept the pole sections on the ground or the platform, two construction workers are sufficient then to cover large facade surfaces with mobile scaffolding in a short time.

Using scaffold bridges on horizontal rails perpendicular to the facade wall and in the opposite direction, the advantage results that no spaces between the facade and the mobile platform are left which put anyone or anything in danger of falling.

In addition, the possibly exists to eventually drive around the sections of the facade mentioned above. This can be achieved by folding the railing on the facade side of the mobile platform to the platform floor such that an additional piece of platform floor is created that fills out the free space between the facade and the platform. This has the additional advantage that after releasing the railing between the construction worker and the facade, no disruptive pieces of the mobile platform remain.

Between the individual scaffolding poles many mobile platforms can be shifted independently from each other along the scaffolding poles. With the current connector located on the scaffolding pole, the mobile platforms can be equipped with current for the construction worker's tools. The length of the mobile platforms between the poles is freely choosable by connecting individual platform segments.

For assembly of large construction pieces several platforms can be coupled. Positioning devices running on a mounting on the mobile platform over horizontal guide rails running in parallel to the facade which can individually conduct the functions:

a) acceptance of plates or bar-shaped construction pieces from the ground or from the materials elevator;

b) movement of these plates;

c) exact positioning of these construction pieces; and d) release of these construction pieces after attaching them to facade.

After all scaffolding poles have been erected, the slide block can be equipped with additional functions through several exchangeable modules, for example a crane jib, which can transport large and heavy construction pieces on a scaffolding pole reaching up over the roof similar to an otherwise typical construction crane on the roof, or a personnel and/or materials elevator, which can not only transport construction workers and material between the individual mobile platforms on the roof, but rather to the facade or to construction openings in the building by rotational movement. On a scaffolding pole in a suitable arrangement, a slide block with crane module, for example, and any desired number of sliding blocks with lift modules can be connected which can be shifted independently from one another.

The invention will be better understood by reference to the accompanying drawings taken with the following discussion.

DETAILED DESCRIPTION OF THE PREFERRED EMBODIMENTS

Figure 9:
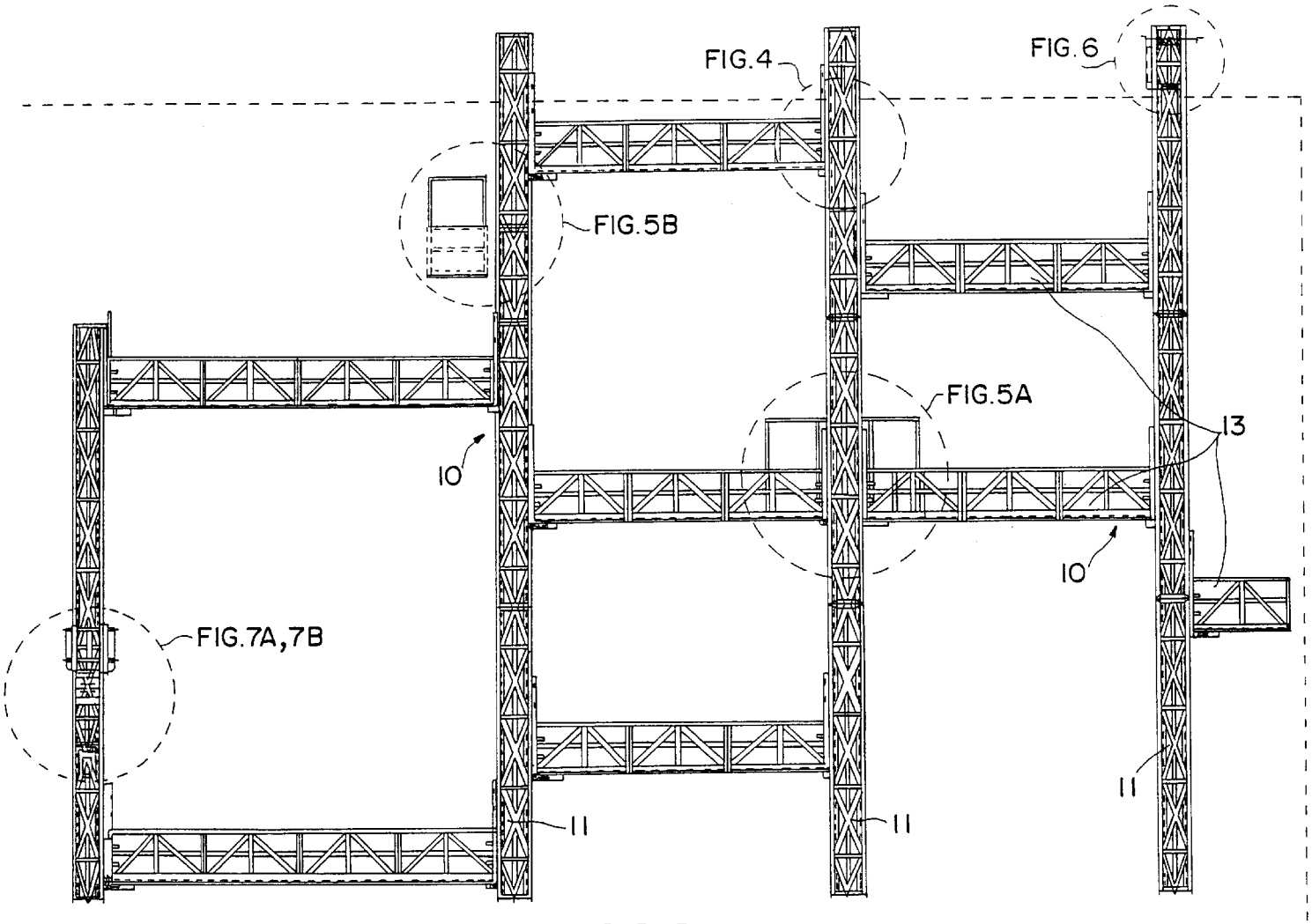
FIG. 9 is a front view of the scaffold assembly according to the invention.

The lifting scaffold assembly 10 shown in the drawings (see FIG. 9) has several scaffolding poles 11 which stand on the ground 12 (see FIGS. 1A and 1B) or on a platform above the ground, each scaffolding pole being formed of pole sections mounted end-to-end. Between the scaffolding poles 11 mobile platforms 13 are provided, i.e., platforms which are connected to adjacent scaffolding poles to be independently vertically movable relative to a building face 15. The scaffolding poles 11 are attached to a building face 15 by means of several holding supports 14 (FIG. 1B).

Figure 1A:
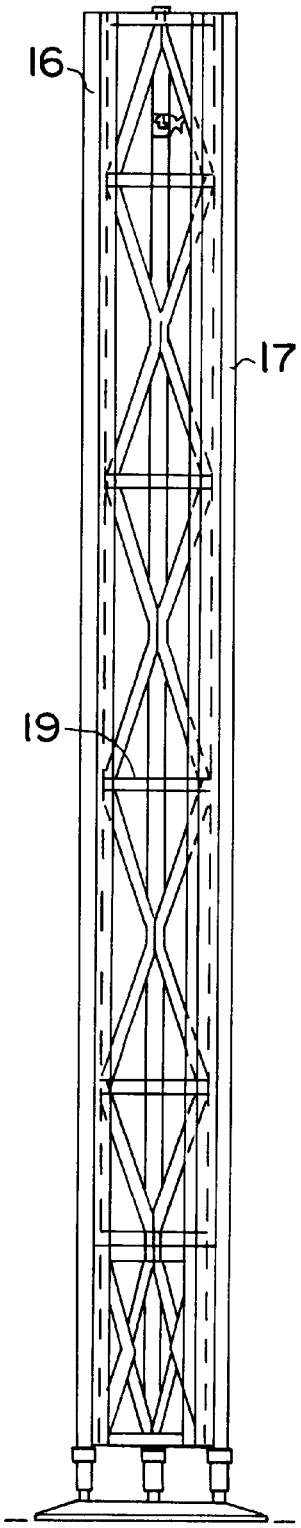
FIGS. 1A and 1B are respective front and side views of one of the vertical scaffolding poles of the inventive scaffold assembly shown in FIG. 9.
Figure 1B:
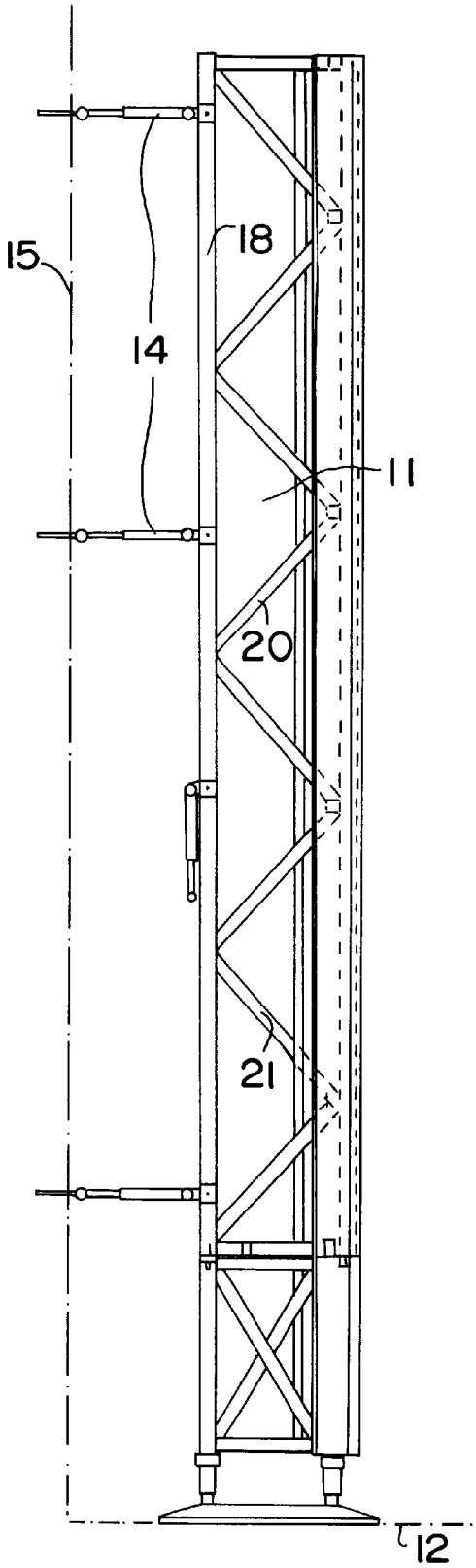
Figure 2:
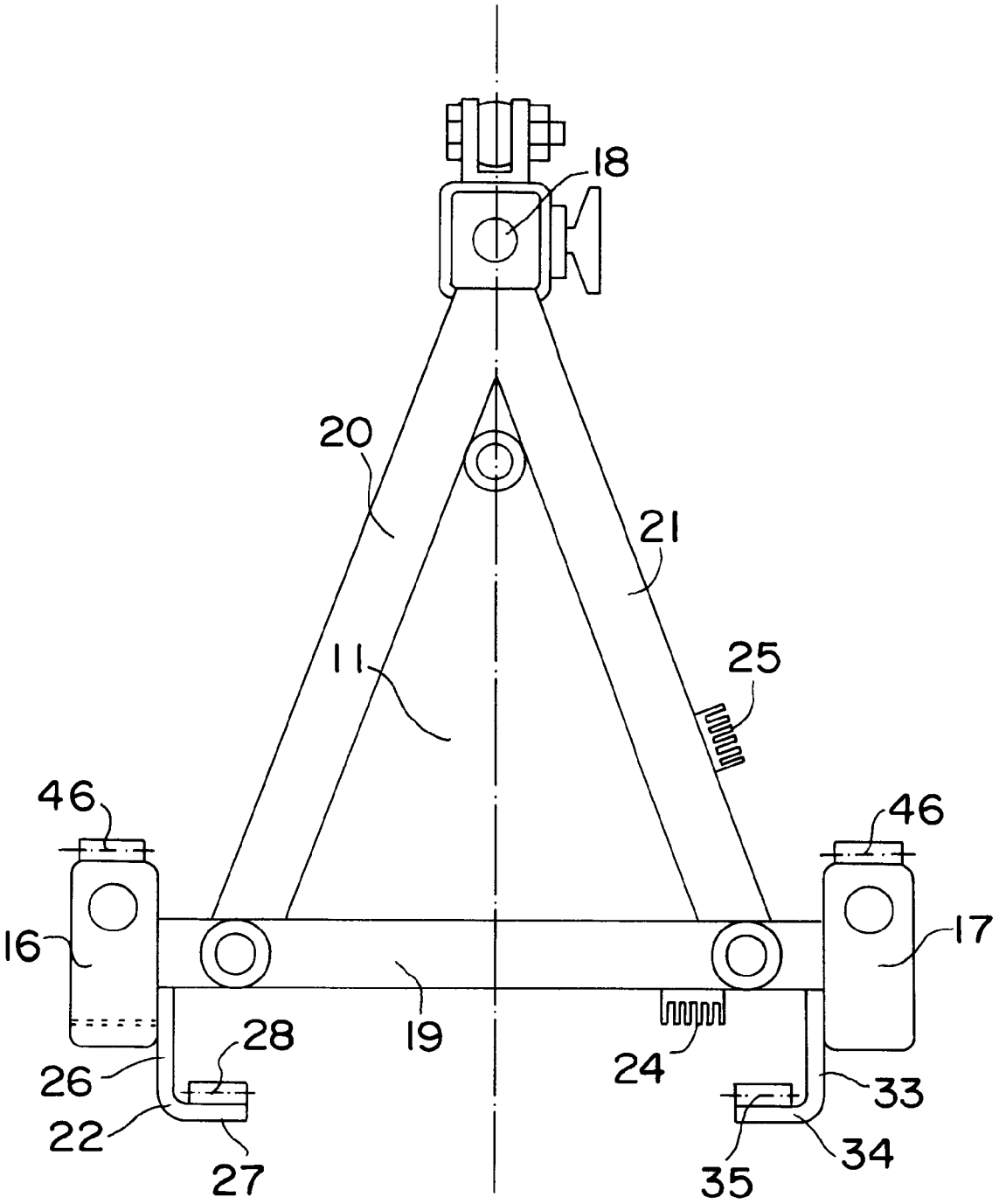
FIG. 2 is a top plan view of one of the scaffolding poles.

As is shown especially in FIGS. 1A, 1B and 2, a scaffolding pole 11 of the lifting scaffold assembly 10 consists of two girder sections 16, 17 and a corner section 18, whereby the girder sections 16, 17 and the corner section 18 create a isosceles triangle. The girder sections 16, 17 and the corner section 18 are stabilized by cross- and oblique-running struts 19, 20, 21.

Figure 3A:
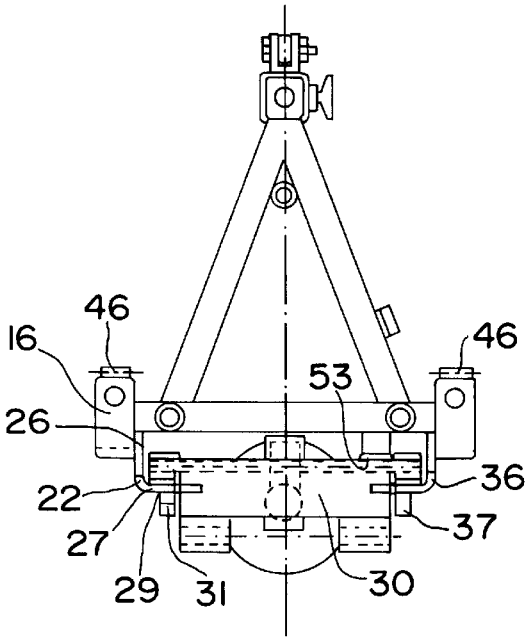
FIG. 3A is a top plan view of the scaffolding pole of FIGS. 1A and 1B with a carriage movably mounted thereon.

As is shown especially in detail in FIG. 2, the mobile section 22 is attached with the inner profile flange 26 on the inner side of the girder section 16, while free profile flange 27 is bent inward by 90°. On the free profile flange 27 a gear rack 28 is provided, on which a cogwheel 29 of a sliding block (carriage) 30 runs, the carriage providing a support wheel (3) which contacts the opposite side of the free flange 27 is (see FIG. 3A). The dotted line 32 in FIG. 4 designates a line of symmetry and in the top view a plane of symmetry between the left and right areas of the lifting pole 11 shown in FIG. 8. In this way, the construction pieces 33, 34, 35, 36, 30, 37 on the right side of the plane of symmetry 32 correspond to the construction pieces 26, 27, 28, 29, 30, 31 on the left side of the plane of symmetry 32. On the right side of the plane of symmetry 32 in FIG. 4 a mobile platform 38 with railings 39, 40 and 41, as well as with shiftable railing 42, is arranged. On the mobile platform 38 a bracket 44 is provided on which two cogwheels 45 to be driven are provided, which run in a gear rack 46 of the girder section 17. In addition, two opposing castors 47, 48 are provided on the bracket 44 and a castor 50 is also provided in an additional bracket 49, through which it is ensured that the cogwheel 45 remains constantly in secure contact with the gear rack 46. The drive of the cogwheel 45 derives from the shaft 51.

On the bracket 44 a current collector 52 is provided, which is held on the conducting rail 25 such that the current collection can be shifted and slide on the conduction rail 25. Likewise a current collector 53 is provided on the sliding block 30, which is contacted tightly againist the conduction rail 24 or rather slides in the conduction rail 24.

On the left side of the plane of symmetry 32 the above described relationships are the same. The mobile platform 54 has railings 55, 56 which correspond to the railings 39, 41. The railing 57 which corresponds to railing 42 is shiftable toward the facade on the left side of the plane of symmetry 32 and the folded railings 39 and 55 are released toward the facade so that the mobile platform lies quite close to the facade 15, so that accidents become impossible.

Between the corner section 18 and one of the pins 58 set into the facade 15 the variable length holding support 14 is arranged between a bearing 59 and a hook 60.

Figure 4:
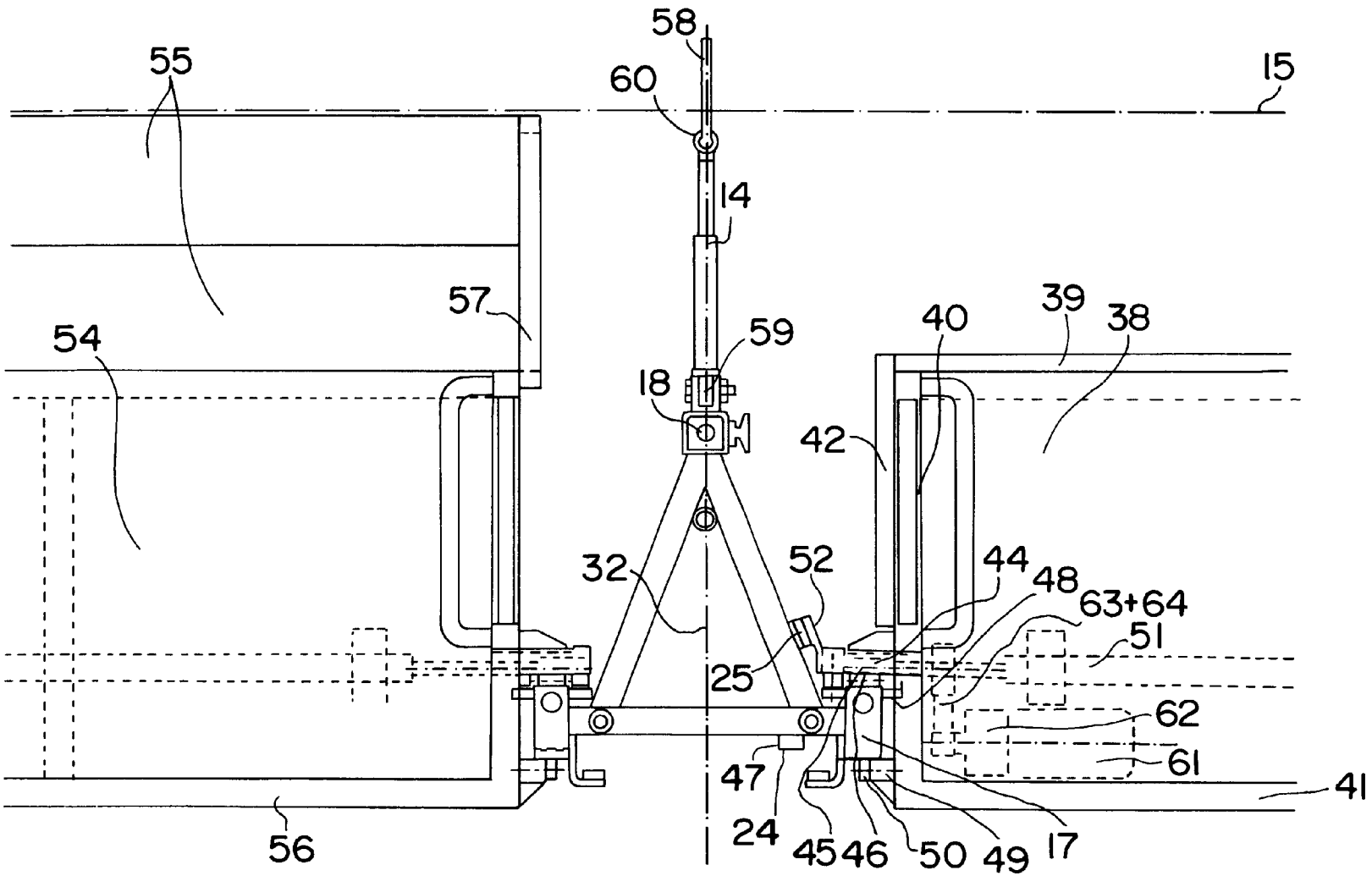
FIG. 4 is a top plan view of the scaffolding pole of FIGS. 1A and 1B with mobile platforms movably mounted on opposite sides thereof.

In accordance with the representation in FIG. 4, a motor 61 is provided which drives the drive shaft 51 over a gear 62 and over cogwheel 63, 64.

Figure 5A:
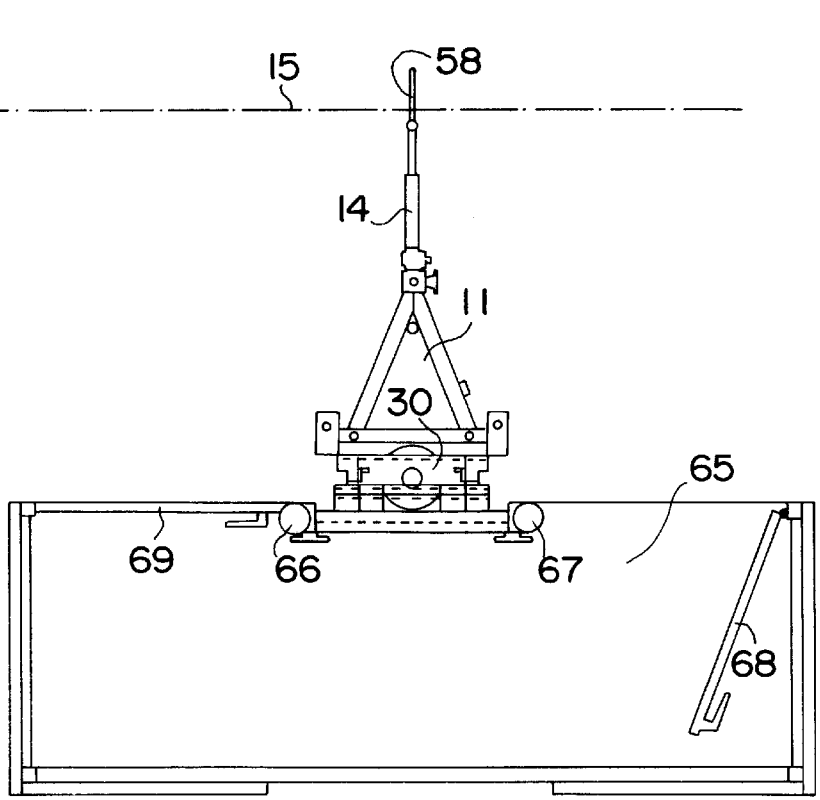
FIGS. 5A and 5B are a top plan view of the scaffolding pole of FIGS. 1A and 1B and an elevator movably mounted thereon and showing drive (FIG. 5A) and turned (FIG. 5B) orientations.
Figure 5B:
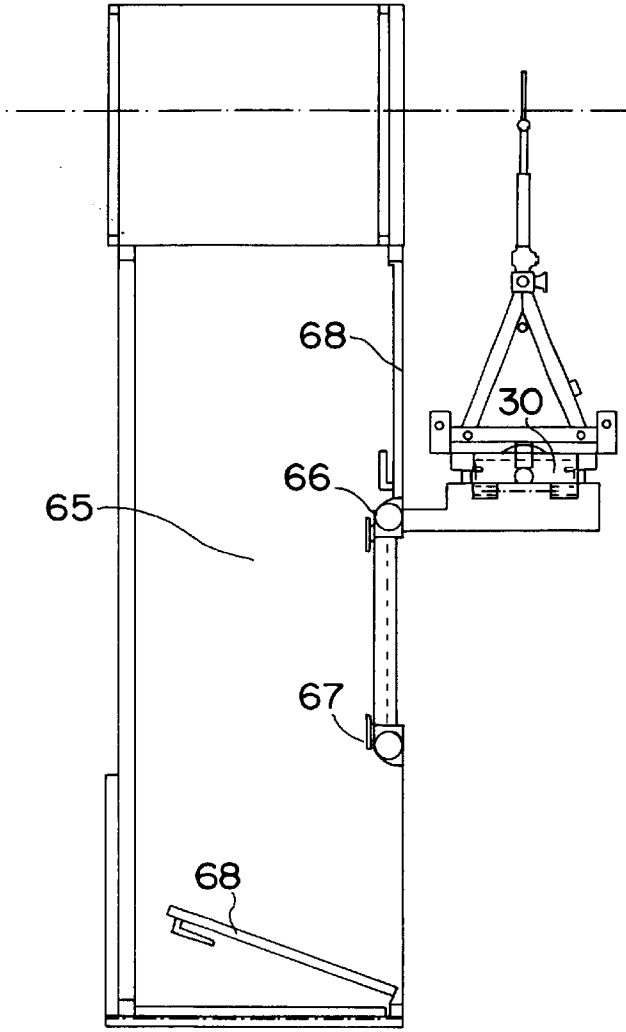

In addition, in FIGS. 5A and 5B a elevator 65 is arranged on a sliding block 30, which is swivelled on joints 66, 67 across from the sliding block 30. In the illustrative example represented, in FIG. 5A, the elevator 65 is turned 90° around the joint 66 relative to the longitudinal orientation of the scaffold.

In accordance with FIG. 5B, the material and/or personnel elevator 65 is oriented in the direction of the scaffold. The elevator has turnable doors 68, 69 through which to attend to and access the individual platforms, provided that the platform itself is not moving.

Figure 6:
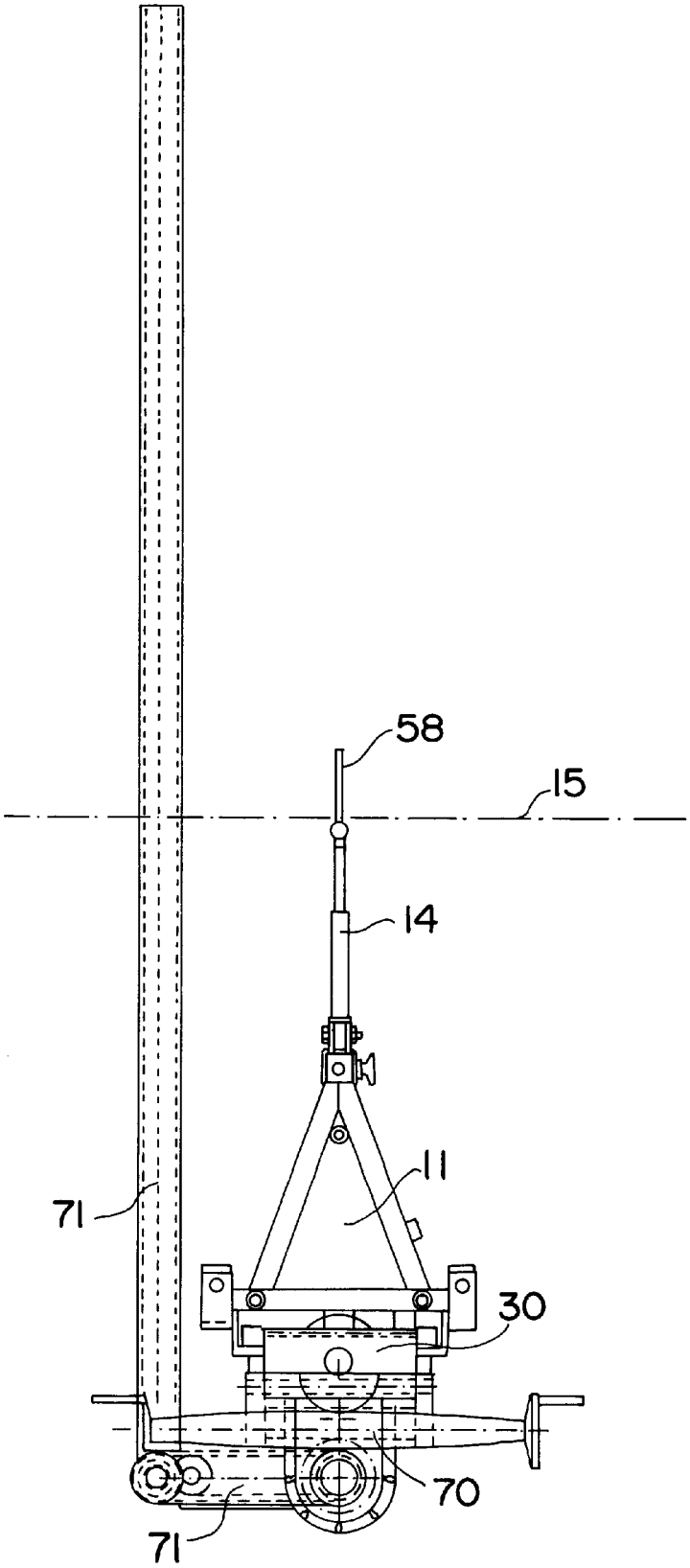
FIG. 6 is a top view of the scaffolding pole and a crane movably mounted thereon.
Figure 7A:
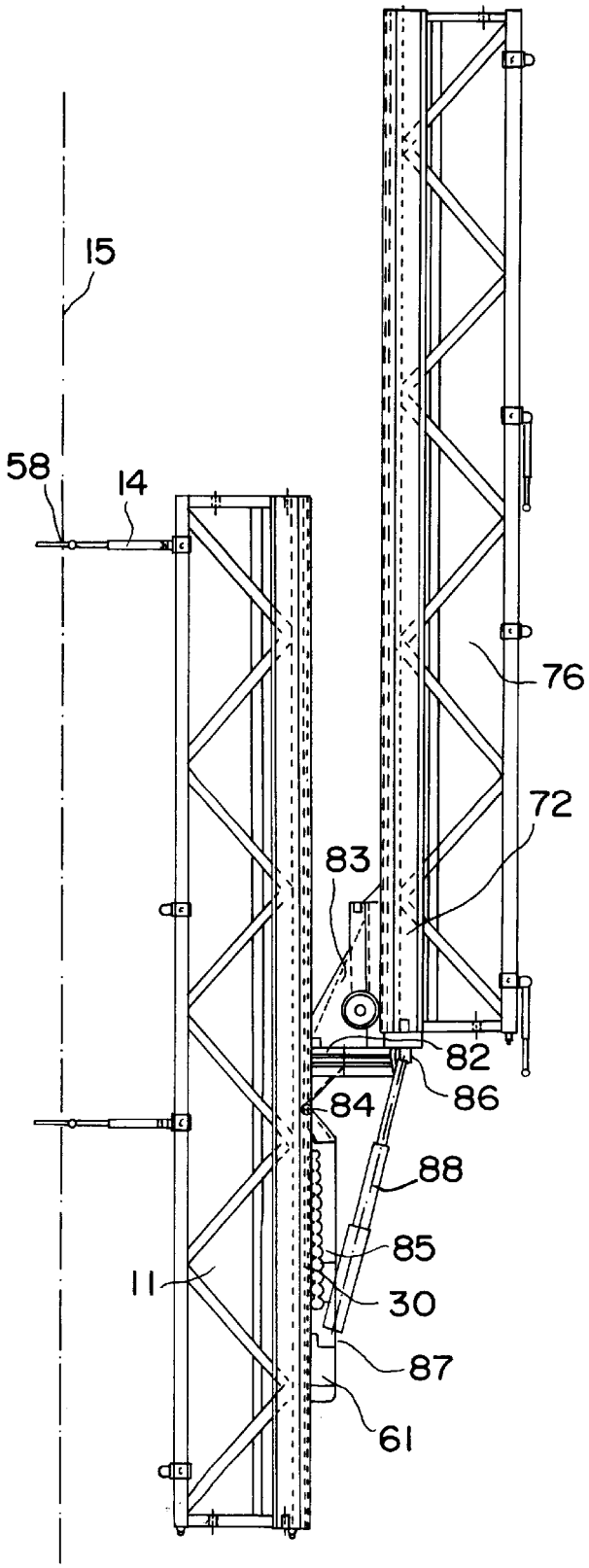
FIG. 7A is a side view of the scaffolding pole, carriage movably mounted thereon, and pole transport module with scaffolding pole section mounted on the carriage.
Figure 7B:
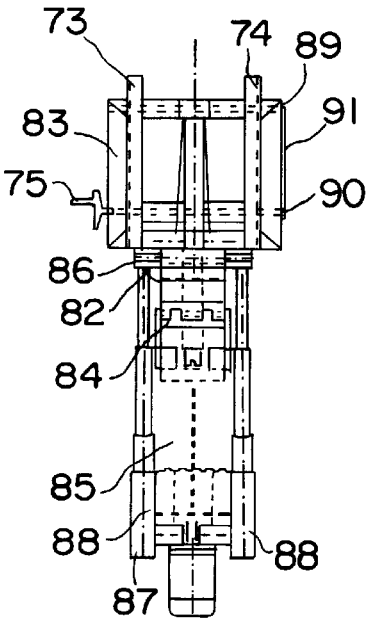
FIG. 7B is a front view of the carriage and pole transport module.
Figure 8:
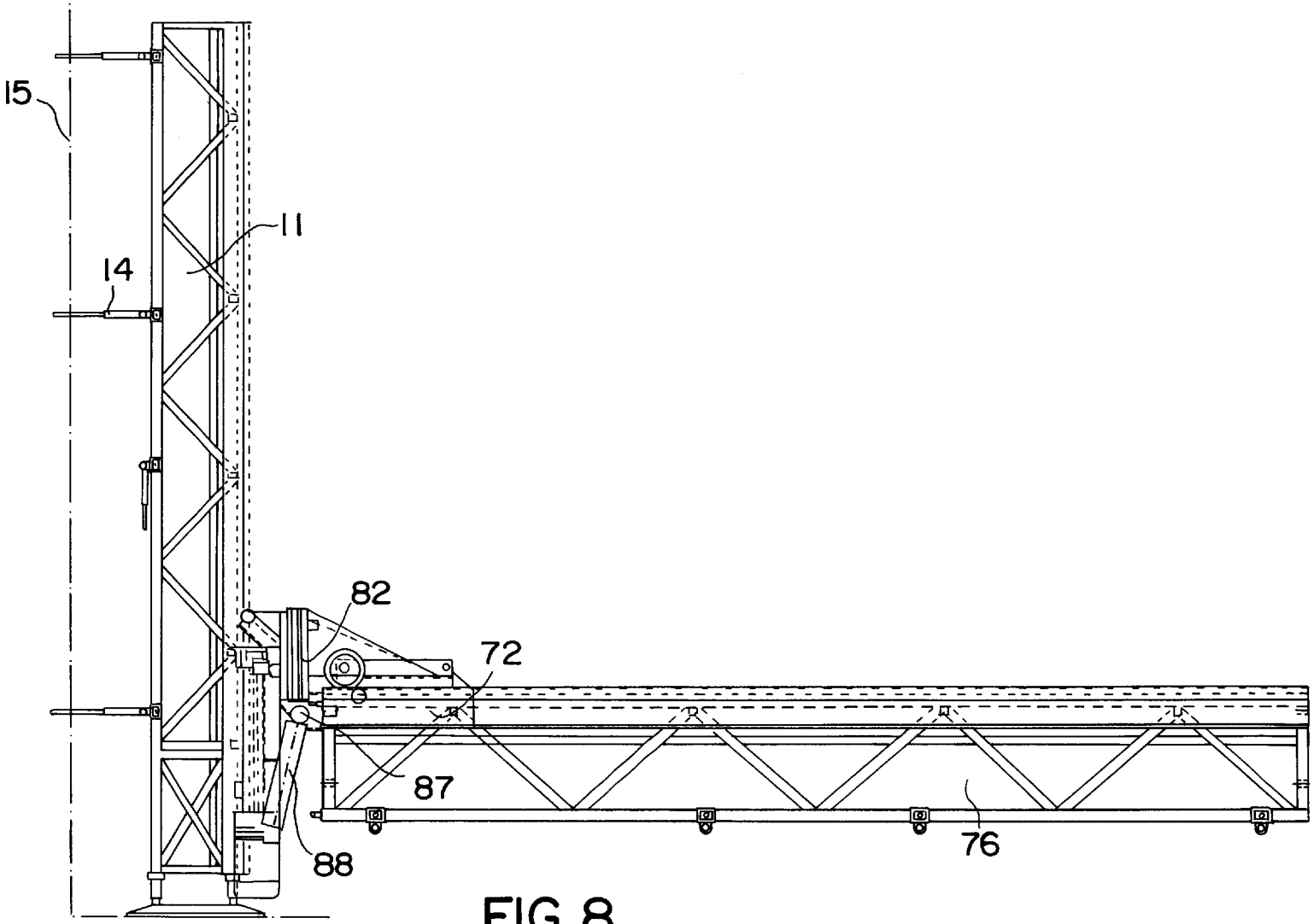
FIG. 8 is a side view of the scaffolding pole, carriage and pole transport module, with the pole transport module oriented for mounting of a scaffolding pole section thereon.

The arrangement shown in FIG. 6 differs from those shown in FIGS. 7A, 7B and 8 in that instead of the elevator 65, a crane 70 with a sectioned crane jib 71 is provided. The remaining arrangements are similar to the arrangements described above or are otherwise known. In FIG. 7A, 7B a clamp 72 is provided on the sliding block 30 of the scaffolding pole 11, both of whose jaws 73, 74 are opened and closed by a wheel 75. Between the two jaws 73, 74 a section of scaffolding pole 76 is clamped, which is turned 180° relative to the already built scaffolding pole 11 and in this state can be lifted by means of the sliding block 30 and the pincers 72 and turned back 180° at the desired height, so that it is aligned with the already built scaffolding pole 11 and can be erected on this and connected thereto.

Figure 3B:
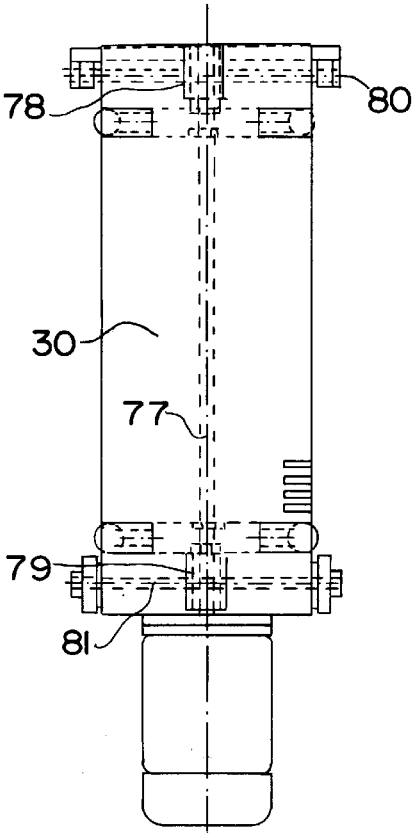
FIGS. 3B and 3C are front and side views of the carriage depicted in FIG. 3A.
Figure 3C:
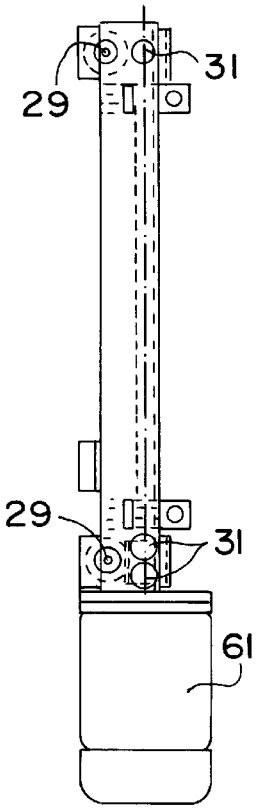

In FIGS. 3B and 3C the sliding block is represented by itself. A bar 77 is driven by the motor 61, which has two screws 78, 79 over which the four cogwheels 29 are driven by means of axles 80, 81. Likewise the support wheels are represented.

In FIGS. 7A, 7B a round disk 82 is provided which is attached to the pincers 72 of the sliding block 30. On the disk 82 a bracket 83 is provided, on which the bracket 85 is mounted flexibly in a joint 84. In a joint 86 of the plate 82 and a joint 87 of the bracket 85 a multiple-leveled cylinder 88 is provided and with the help of which the joint 86 can be turned on the arc of a circle around the joint 84 until the disk 82 takes the position perpendicular to this.

In addition, a driving chain 91 is provided between two chain wheels 89, 90, so that a forced synchronism is achieved.

Although specific embodiments of the invention have been shown and described, changes and modifications are possible without departing from the scope of the appended claims.

I claim:

1. In combination, a scaffold assembly and a platform assembly, said scaffold assembly comprising a plurality of vertical pole assemblies, each pole assembly including first and second vertical girders, a plurality of first struts connected between said first and second girders, support means for attaching the first girder to a vertical wall, an L-shaped profile element connected to each of said first and second girders, each L-shaped profile element including a first portion which extends away from said first struts and a second portion which extends in parallel with said first struts, wherein said second portion mounts a first rack on a side thereof facing said first struts, wherein a first conductor rail is mounted on said first struts on a side facing said second portions of said L-shaped profile elements, and including a carriage positioned between said L-shaped profile elements, said carriage including a cog wheel for contacting and moving along said first rack and a current collector for contact with said first conductor rail, said scaffold assembly including a second rack and a second conductor rail, and said platform assembly including a cogwheel for contacting and moving along said second rack so as to be vertically movable along at least one of said pole assemblies, and a current collector for contact with said second conductor rail.

2. The combination according to claim 1, wherein each pole assembly includes a corner section connected to said first and second girders by respective second and third struts, and wherein said support means are connected to said corner section.

3. The combination according to claim 2, wherein said second conductor rail is mounted on a said third strut.

4. The combination according to claim 1, wherein said second rack is located on one of said first and second girders on a side thereof facing said corner section.

5. The combination according to claim 4, wherein said platform assembly includes a motor for driving said cogwheel thereof along said second rack.

6. The combination according to claim 1, including a plurality of platforms connected between two of said pole assemblies and independently movable along a length of said pole assemblies.

7. The combination according to claim 1, wherein each vertical pole assembly comprises a plurality of pole sections interconnected end-to-end.

8. A lift frame (10) comprising a plurality of frame uprights (11), which are longitudinally extendable and between which are height-variably situated platforms (13), wherein the frame uprights may be fixed on a facade of a building by a plurality of holders, wherein every frame upright (11) comprises at least one carrier section (16) on which is provided at least one first rack (28) with which engage pinions (29) situated on the movable platforms and driven by drives (61), each frame upright including at least one second rack (46), a carriage (30) with pinions (29) movably connected to said second rack so as to be movable along said rack, said carriage including drive means for said pinions (29), and and current supply bars (24, 25) are provided on the frame upright (11) and current collectors (52, 53) are provided on the movable platforms (38, 54) and the carriage (30).

9. A lift frame according to claim 8, wherein the frame upright (11) comprises two carrier sections (16, 17) with racks (28, 46).

10. A lift frame according to claim 8, wherein one of the devices which can be coupled to the carriage (30) is a frame upright transport device.

11. A lift frame according to claim 8, wherein one of the devices which can be coupled to the carriage (30) is a crane (70).

12. A lift frame according to claim 8, wherein the movable platform (38, 54) is provided with a positioning device which is movable along the whole width of the movable platform (38, 54) by a movable mounting.

13. A lift frame according to claim 8, wherein the movable platform (38, 54) is along its length freely fixable between the frame uprights (11).

14. A lift frame according to claim 8, wherein a guard rail (39, 40, 41, 42, 55, 56, 57) of the movable platform pointing to the facade (15) may be used for widening of the platform floor towards the facade (15).

15. A lift frame according to claim 8, wherein an electric or electrohydraulic drive for the pinions (29) is provided on the carriage (30).

16. A lift frame according to claim 8, wherein the movable platforms (38, 54) have electric or electrohydraulic drives for driving the pinions (45).

17. A lift frame according to claim 8, wherein two pinions (29, 45) are provided one above the other for every drive.

18. A lift frame according to claim 8, wherein two pinions (29, 45) are provided opposite to each other for every drive.

19. A lift frame according to claim 8, wherein two racks (28, 46), positioned opposite to each other, are provided on every carrier section (16, 17) of the frame uprights (11), one pinion (29, 45) running in every rack.

20. A lift frame according to claim 8, wherein two racks (28, 46), positioned opposite to each other, are provided on every carrier section (16, 17) of the frame uprights (11), more than one pinion (29, 45) running in every rack.

21. A lift frame according to claim 8, wherein at least one pinion (29, 45) is provided to safeguard against the crash of the carriage (30) and the movable platform (38, 54) or a device is provided for this purpose.

22. A lift frame according to claim 8, wherein between the individual frame uprights any number of movable platforms may be displaceable along the frame uprights independently of each other.

23. A lift frame (10) comprising a plurality of frame uprights (11) which are longitudinally extendable and between which are height-variably situated platforms (13), wherein the frame uprights may be fixed on a facade of a building by a plurality of holders, wherein every frame upright (11) comprises at least one carrier section (16) on which is provided at least one first rack (28) with which engage pinions (29) situated on the movable platforms and driven by drives (61), each frame upright including at least one second rack (46), a carriage (30) with pinions (29) movably connected to said second rack to be movable along said rack, said carriage including drive means for said pinions (29), current supply bars (24, 25) are provided on the frame upright (11) and current collectors (52, 53) are provided on the movable platforms (38, 54) and the carriage (30), and at least one of said movable platforms and said carriage being a lift for persons or material which is tiltable to opposite sides about the frame upright towards the facade.

24. A lift frame (10) comprising a plurality of frame uprights (11) which are longitudinally extendable and between which are height-variably situated platforms (13), wherein the frame uprights may be fixed on a facade of a building by a plurality of holders, wherein every frame upright (11) comprises at least one carrier section (16) on which is provided at least one first rack (28) with which engage pinions (29) situated on the movable platforms and driven by drives (61), each frame upright including at least one second rack (46), a carriage (30) with pinions (29) movably connected to said second rack to be movable along said rack, said carriage including drive means for said pinions (29), current supply bars (24, 25) are provided on the frame upright (11) and current collectors (52, 53) are provided on the movable platforms (38, 54) and the carriage (30), and the movable platforms are movable on rails horizontally and parallel to the facade.

* * * * *